US006919501B2

(12) United States Patent
Burton

(10) Patent No.: US 6,919,501 B2
(45) Date of Patent: Jul. 19, 2005

(54) GUITAR TREMOLO LOCKING AND TUNING STABILIZING DEVICE

(76) Inventor: William L. Burton, 4 W. Main St., Springfield, OH (US) 45502

( * ) Notice: Subject to any disclaimer, the term of this patent is extended or adjusted under 35 U.S.C. 154(b) by 76 days.

(21) Appl. No.: 10/693,907

(22) Filed: Oct. 28, 2003

(65) Prior Publication Data

US 2004/0083875 A1 May 6, 2004

Related U.S. Application Data

(60) Provisional application No. 60/421,790, filed on Oct. 29, 2002.

(51) Int. Cl.[7] ..... G10D 3/00
(52) U.S. Cl. ..... 84/313
(58) Field of Search ..... 84/313, 312 R, 84/267, 298, 299, 307

(56) References Cited

U.S. PATENT DOCUMENTS

| | | | | |
|---|---|---|---|---|
| 668,604 A | | 2/1901 | Russell | |
| 1,747,650 A | | 2/1930 | Sawyer | |
| 1,755,019 A | | 4/1930 | Parker, Jr. | |
| 4,171,661 A | | 10/1979 | Rose | |
| 4,285,262 A | | 8/1981 | Scholz | |
| 4,383,466 A | | 5/1983 | Shibuya | |
| 4,608,906 A | | 9/1986 | Takabayashi | |
| 4,611,523 A | * | 9/1986 | McFarland | 84/313 |
| 4,656,916 A | | 4/1987 | Gressett, Jr. | |
| 4,677,891 A | * | 7/1987 | Gressett et al. | 84/313 |
| 4,882,967 A | | 11/1989 | Rose | |
| 5,311,804 A | | 5/1994 | Wilkinson | |
| 5,986,192 A | | 11/1999 | Wingfield et al. | |

* cited by examiner

*Primary Examiner*—Kimberly Lockett
(74) *Attorney, Agent, or Firm*—Richard C. Litman

(57) ABSTRACT

A locking and tuning stabilizing device for an electric guitar having a tremolo device includes a clamp screw and an adjustment screw to enable the player to lock the tremolo or to stabilizing the tuning of the strings by turning an appropriate, easily accessible knob projecting from the guitar. In a first embodiment, an axially movable pin is in contact with the tremolo device at one end and in contact with an adjustment screw disposed in the end of the guitar at the opposite end. In second and third embodiments, an anchor block is disposed within a cavity on the back of the guitar. A pin connects to the tremolo device and is axially slidable within the anchor block. Clamping the pin to a fixed position within the anchor block, by tightening a clamp screw disposed in the anchor block, functions to lock the tremolo device in place.

6 Claims, 15 Drawing Sheets

GUITAR TREMOLO LOCKING AND TUNING STABILIZING DEVICE

CROSS-REFERENCE TO RELATED APPLICATION

This application claims the benefit of U.S. Provisional Patent Application Ser. No. 60/421,790, filed Oct. 29, 2002.

BACKGROUND OF THE INVENTION

1. Field of the Invention

The present invention relates to electric guitars equipped with "floating bridge" tremolo devices. More specifically, the invention is a locking and tuning stabilizing device which modifies a Floyd Rose floating bridge tremolo device to permit the user to more easily lock the tremolo device, thereby stopping the tremolo effect, which stabilizes the tuning. With the present invention, locking the tremolo device can be performed quickly and easily by manually turning respective knobs that are located at conveniently accessible locations on the guitar, even when playing the guitar.

2. Description of Related Art

Tremolo devices used on stringed instruments, such as guitars, have been used for a long time. One of the original and still very popular solid-body electric guitars equipped with a tremolo device is the guitar built by the Fender Musical Instruments Corporation (Scottsdale, Ariz.), which dates back to the 1950's. However, more recently, this type of tremolo device has been replaced with a more widely used tremolo device called the "Floyd Rose" tremolo device, originally patented in 1979 by Floyd Rose in U.S. Pat. No. 4,171,661, discussed below. In both the original Fender and the original Rose versions, the tremolo devices are blocks that pivot on a fulcrum located on the front face of the guitar. On one side of the fulcrum, the tremolo block is fastened to the strings on the front face of the guitar; on the opposite side, the tremolo block is attached to springs that, in turn, are fastened to the guitar body in a cavity near the rear face.

U.S. Pat. No. 668,604, issued to Russell on Feb. 19, 1901, U.S. Pat. No. 1,747,650, issued to Sawyer on Feb. 18, 1930, and U.S. Pat. No. 1,755,019, issued to Parker, Jr. on Apr. 15, 1930, broadly teach stringed musical instruments that have tremolo effects created by bending the neck of the instrument back-and-forth relative to the body.

U.S. Pat. No. 4,171,661, issued to Rose on Oct. 23, 1979, teaches a guitar with a tremolo device in which the strings are intended to stay in tune when the tremolo device is not being used.

U.S. Pat. No. 4,285,262, issued to Scholz on Aug. 25, 1981, teaches a tremolo device in which all the strings can be re-tuned simultaneously.

U.S. Pat. No. 4,383,466, issued to Shibuya on May 17, 1983, teaches a tremolo device for an electric guitar in which the strings can be individually tuned.

U.S. Pat. No. 4,608,906, issued to Takabayashi on Sep. 2, 1986, teaches a guitar tremolo device having a tuning feature.

U.S. Pat. No. 4,656,916, issued to Gressett, Jr. on Apr. 14, 1987, teaches a modified tremolo device which tunes all the strings simultaneously using an adjustment screw extending from the device to the bottom of the guitar.

U.S. Pat. No. 4,882,967, issued to Rose on Nov. 28, 1989, teaches a tremolo device having a locking feature.

U.S. Pat. No. 5,311,804, issued to Wilkinson on Mar. 17, 1994, teaches a spring-loaded locking mechanism for a "floating bridge" tremolo device, such as for a Floyd Rose tremolo device.

U.S. Pat. No. 5,986,192, issued to Wingfield et al. on Nov. 16, 1999, teaches a locking device for tremolo devices on electric guitars.

There is a need in the art, however, for a convenient manner of locking or unlocking the tremolo device whenever desired, particularly by using easily accessible and rotatable knobs on the guitar body.

None of the above inventions and patents, taken either singly or in combination, is seen to describe the instant invention as claimed.

SUMMARY OF THE INVENTION

The present invention is a locking device for a guitar equipped with a tremolo device, specifically of the type typically called the Floyd Rose tremolo block. The Floyd Rose tremolo block is used by electric guitar players to provide a tremolo effect by moving a tremolo arm towards and away from the body of the guitar while playing in order to vary the tension on the strings, the tremolo arm being connected directly to the tremolo block. The tremolo block includes a knife-edge that pivots back-and-forth with the movement of the tremolo arm on a fulcrum, e.g., a pair of spaced screws, which is fixed to the front face of the guitar. On one side of the fulcrum, the tremolo block is fastened to the lower ends of the strings on the front of the guitar. On the opposite side of the fulcrum, the tremolo block is fastened to a set of springs that are, in turn, fastened to the body of the guitar inside a cavity near the rear face of the guitar.

The locking and tuning stabilizing device of the present invention includes an elongated pin extending from the tremolo block, with a compression spring and an adjustment screw axially aligned with the pin, and a clamp screw aligned normal to the pin. When the clamp screw is in an unlocked position, the tremolo device operates as designed to alter tension on the guitar strings in response to movement of the tremolo arm. When the clamp screw is tightened to a locked position against the pin, the tremolo block is unable to pivot, thereby disabling the tremolo device. When the clamp screw is in the unlocked position, the adjustment screw may be moved axially to adjust the bias on the compression spring, which takes any "slack" out of the strings, thereby allowing the device to be as effective as possible.

The locking and tuning stabilizing device may be furnished as original equipment with the guitar, or may be installed as an aftermarket addition to a guitar having a tremolo device.

Accordingly, it is a principal object of the invention to provide a locking and tuning stabilizing device for a guitar equipped with a tremolo device for temporarily disabling the tremolo device.

It is another object of the invention to provide a locking and tuning stabilizing device for a guitar equipped with a tremolo device in which the locking device is easily operable by a single clamp screw.

It is a further object of the invention to provide a locking and tuning stabilizing device for a guitar equipped with a tremolo device having an adjustment screw for adjusting spring bias applied to the tremolo device for more effectively stabilizing the tuning of the guitar strings.

Still another object of the invention is to provide a locking and tuning stabilizing device for a guitar equipped with a tremolo device which may be installed as original equipment with the guitar, or as an aftermarket addition.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a device for locking and stabilizing the tuning of a guitar equipped with a Floyd Rose "floating bridge" tremolo device in order to temporarily disable the tremolo device and to facilitate stabilizing the tuning of the guitar. In addition, the invention prevents the guitar from going out of tune when a guitar string is broken.

Figure 1A:
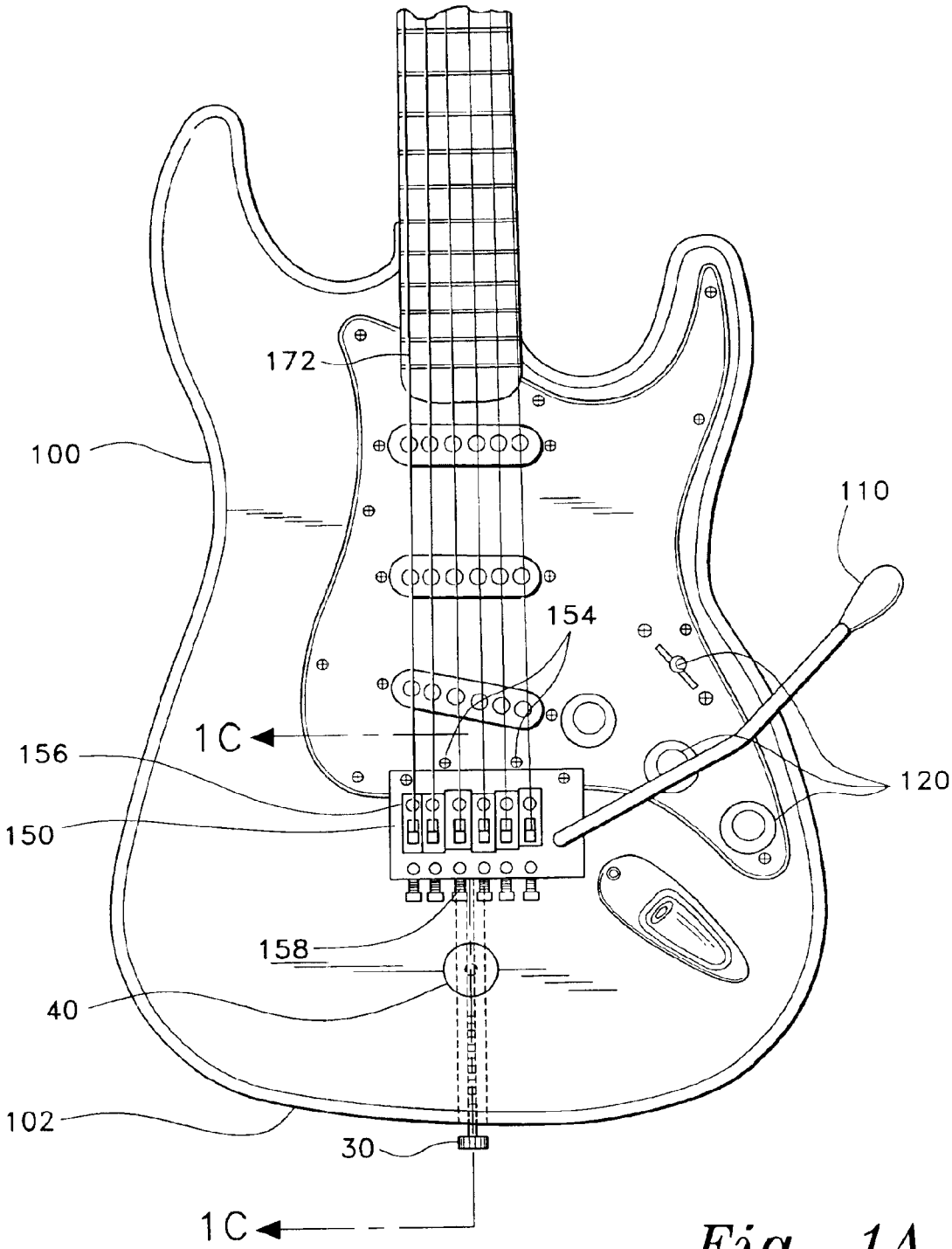
FIGS. 1A and 1B are front and rear plan views, respectively, of a guitar tremolo device modified to include the locking and tuning stabilizing device according to the first embodiment of the present invention.

FIGS. 1A through 5 are directed to a first embodiment of the lock and tuning stabilizing device of the present invention. FIGS. 1A and 1B show a fragmented front view and a fragmented rear view of an electric guitar 100 including a first embodiment a locking and tuning stabilizing device for a Floyd Rose tremolo device. The locking and tuning stabilizing device of the present invention is particularly suitable for use with an electric guitar equipped with a Floyd Rose tremolo device.

Figure 1B:
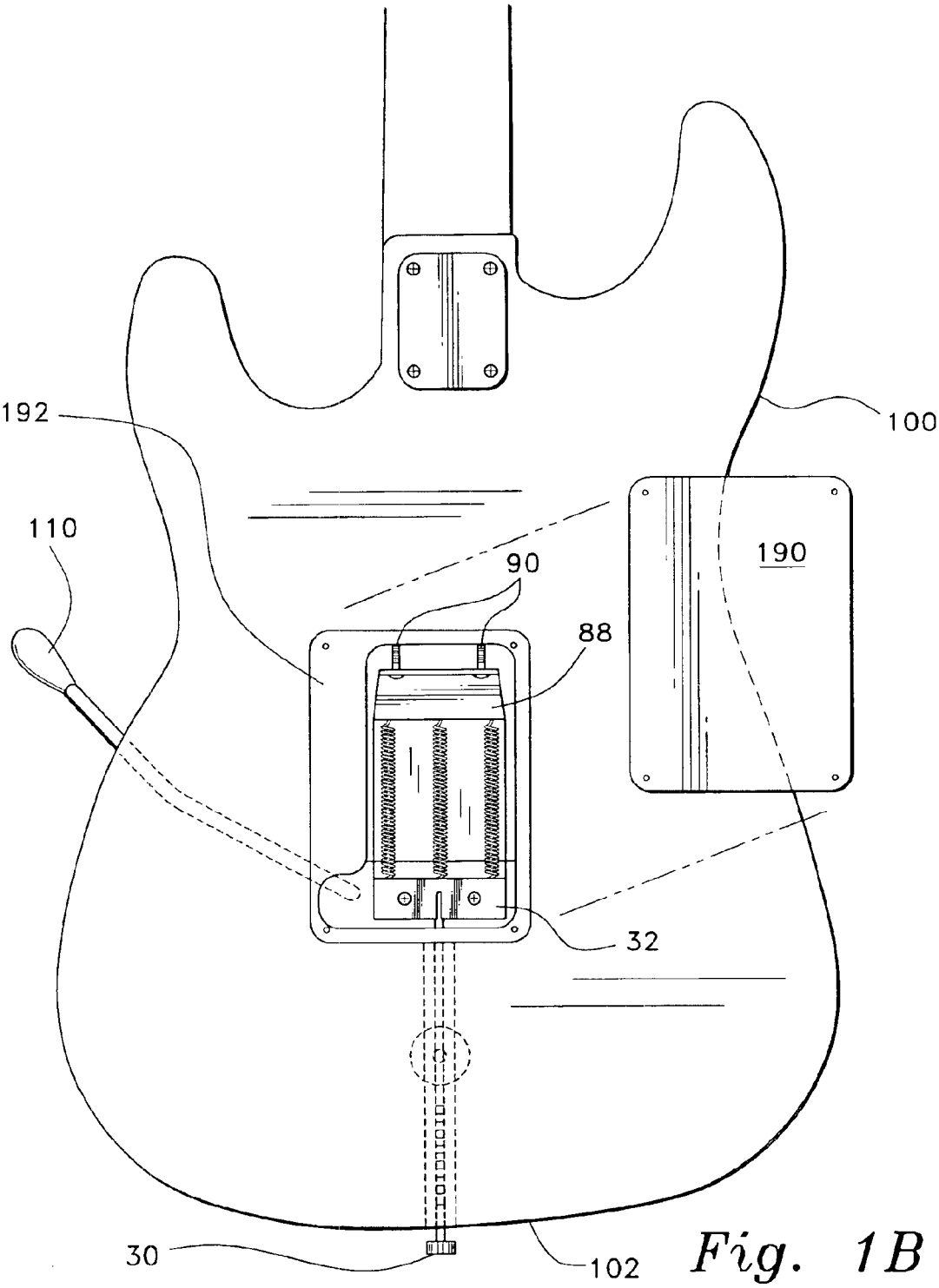
Figure 1C:
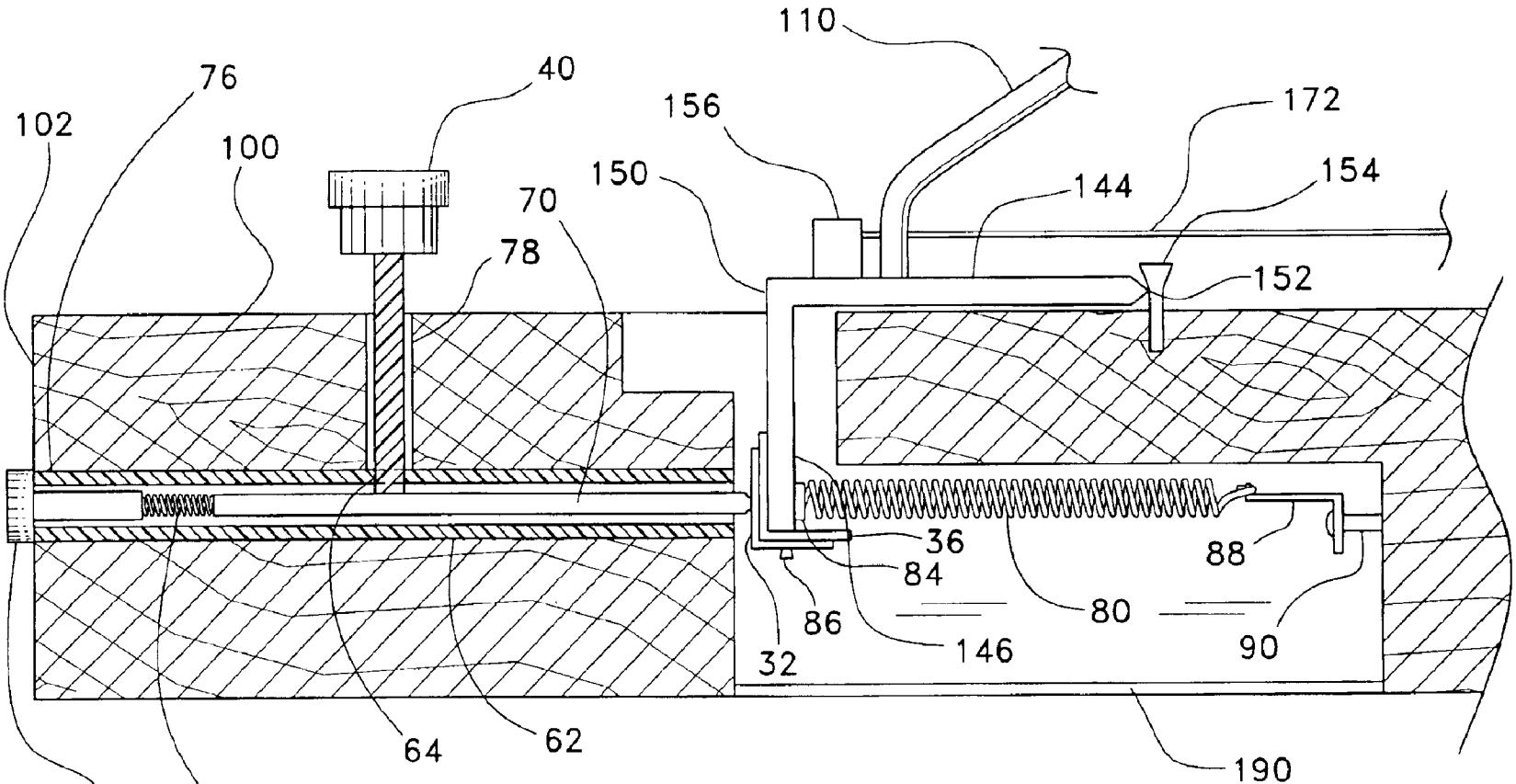
FIG. 1C is a section view along the lines 1C—1C of FIG. 1A.
Figure 2:
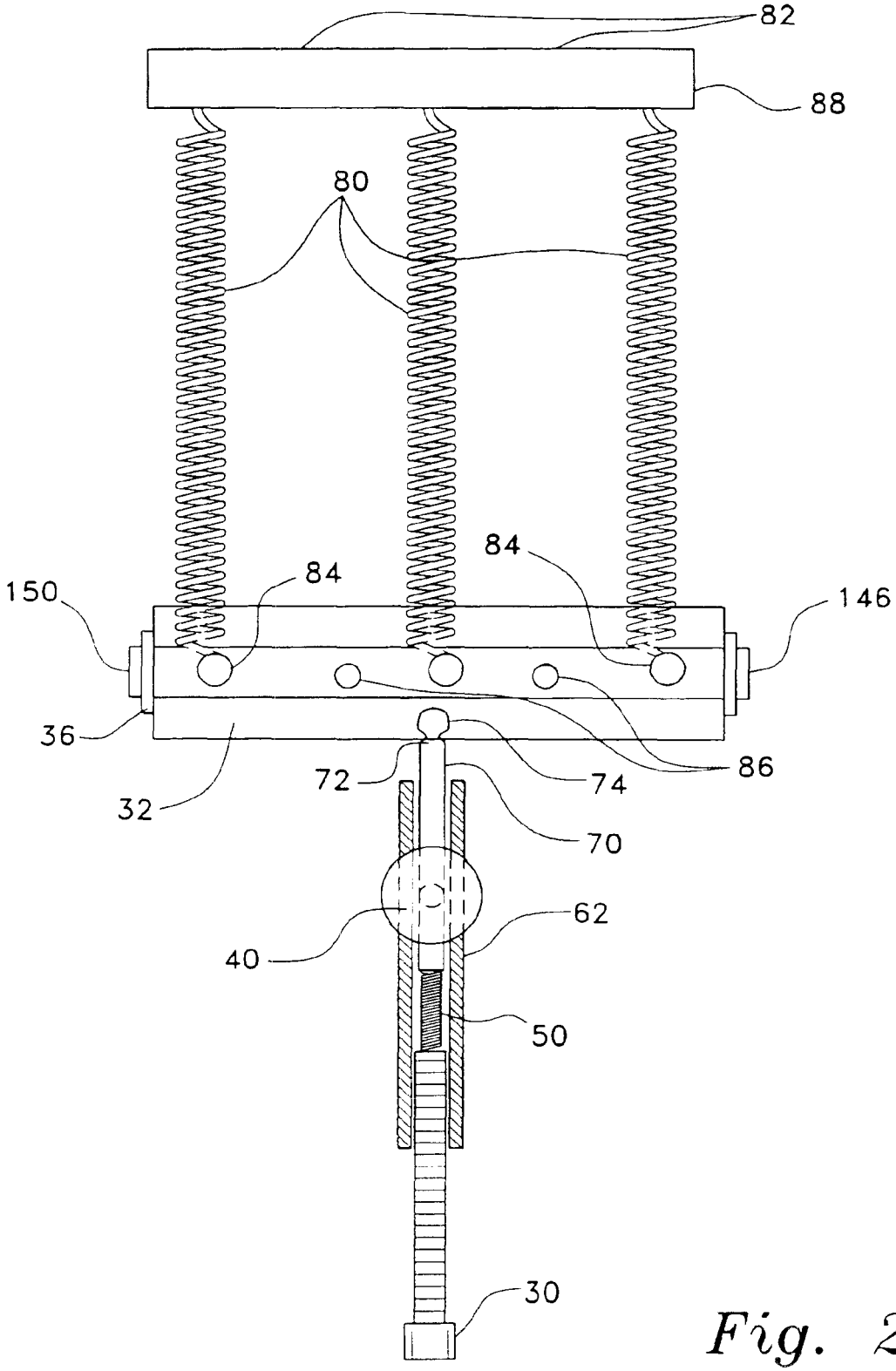
FIG. 2 is a plan view of the first embodiment of the tremolo locking and tuning stabilizing device without the guitar structure.
Figure 5:
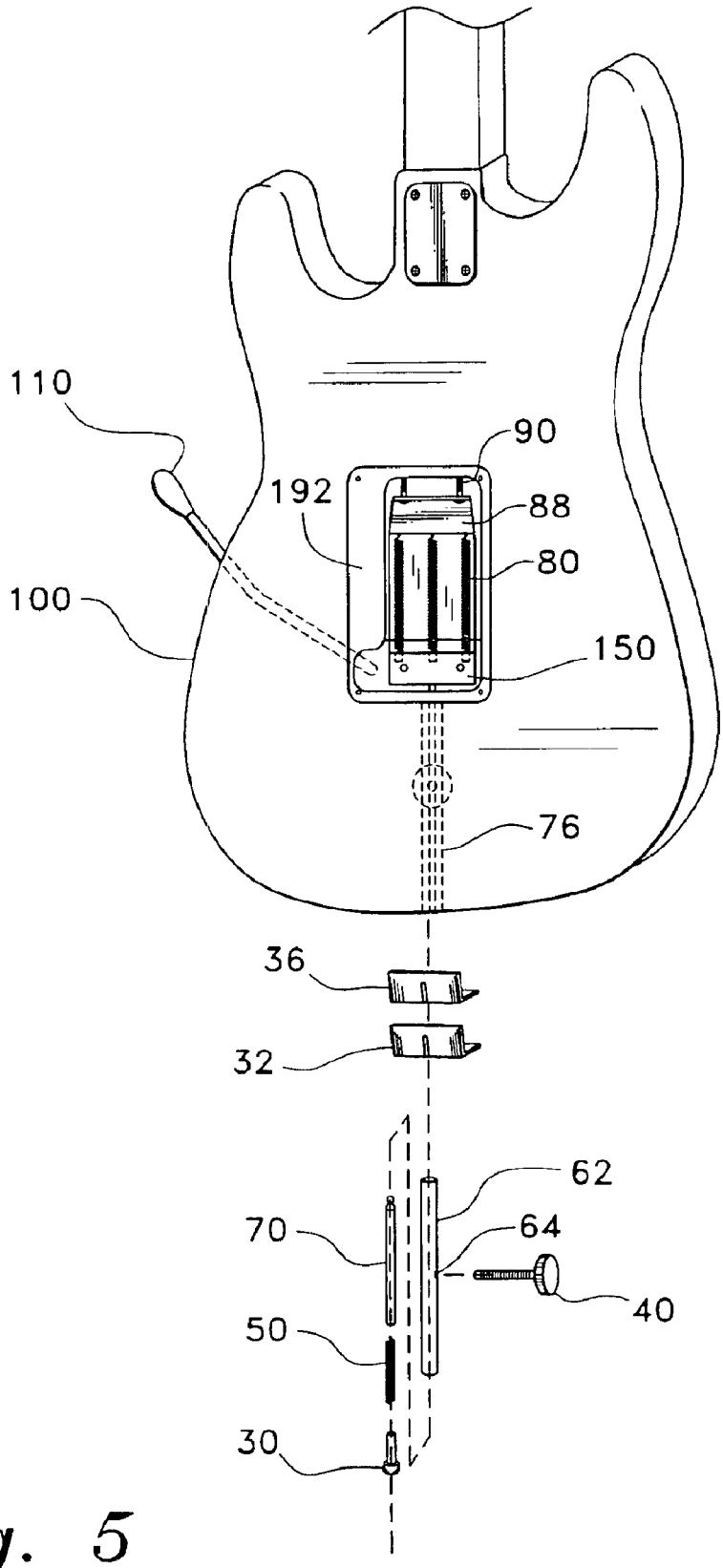
FIG. 5 shows a perspective view of a guitar with the components of the locking and tuning stabilizing device of the present invention exploded.

The guitar 100 is conventional in construction, having a body with a front face and a rear face, a neck extending from the body, and a plurality of strings 172 extending from a tailpiece or bridge 180 up the neck to a nut (not shown) and pegs (not shown) for adjusting tension on the strings 172. A plurality of knobs 120 on the front face of the guitar 100 are electrically connected between a transducer in the body and an amplifier for adjusting the quality of the amplified sound (bass, treble, etc.). As shown in FIGS. 1B and 5, the rear face of the body of the guitar may have a cover 190 providing access to a cavity 192 defined in the body which contains at least some of the components of the tremolo device.

The tremolo device, shown schematically in the drawings, is also conventional in construction. As seen in FIGS. 1A–1C, 2, and 5, the tremolo device includes an L-shaped tremolo block 150 having a first leg or plate 144 extending parallel to the body of the guitar 100, and a second leg 146 extending into the cavity 192. The first leg 144 terminates in a knife-edge 152 which pivots against the neck of one or more screws 154 attached to the front face of the guitar body. The second leg 146 has a plurality of bias springs 80 attached thereto at fitting 84 and disposed in the cavity 192 which extend between the second leg 146 of the tremolo block 150 and an L-shaped bracket 88 affixed to the wall of the cavity, e.g., by screws 90. The bottom ends of the strings 172 are attached to the tremolo block 150 by fittings 156 which include fine adjustment screws 158. A tremolo arm 110 is attached to the tremolo block 150 and extends from the front face of the guitar.

When the guitarist wishes to create a tremolo effect, movement of the arm 110 causes the knife-edge 152 to pivot against screw(s) 154, raising or lowering tremolo block 150 against the bias of springs 80, thereby altering tension on the strings 172 and creating a tremolo effect. The foregoing is conventional in a Floyd Rose tremolo device.

The present invention is a locking and tuning stabilizing device for temporarily locking the tremolo device to prevent its operation, and to provide means for stabilizing tuning of a guitar equipped with the tremolo device. In the first embodiment of the present invention, the guitar body is modified by drilling cylindrical bores into the body, a first bore 76 being perpendicular to and in communication with a second bore 78. The first bore 76 extends from the end 102 of the guitar 100 opposite the neck and into the tremolo cavity 192. The second bore 78 extends from the front face of the guitar into the first bore 76.

The outer portion of the first bore 76 towards the end 102 of the body of the guitar 100 is threaded to receive an adjustment screw 30. The inner portion of the first bore 76 extending between the adjustment screw 30 and the cavity 192 has an elongated, smooth-faced cylindrical sleeve 62 that is fixed essentially flush with the internal surface of the first bore 76 and held in place. An opening 64 is formed in the wall of sleeve 62, and the opening 64 is placed in alignment with the second bore 78. Inside the sleeve 62, a pin 70 is movable axially. A compression spring 50 is disposed between the adjustment screw 30 and the pin 70.

Figure 3A:
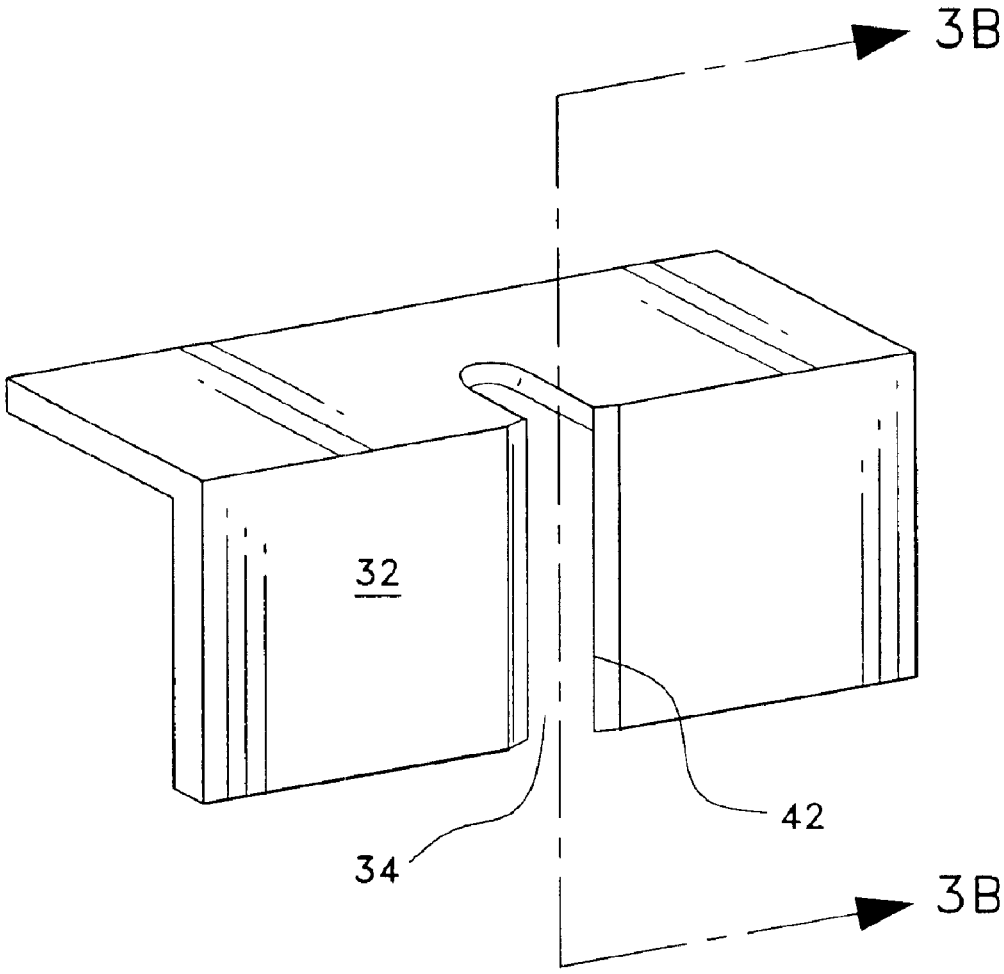
FIG. 3A shows a perspective view of the knife-edged pin bracket of the locking and tuning stabilizing device of the present invention.
Figure 3B:
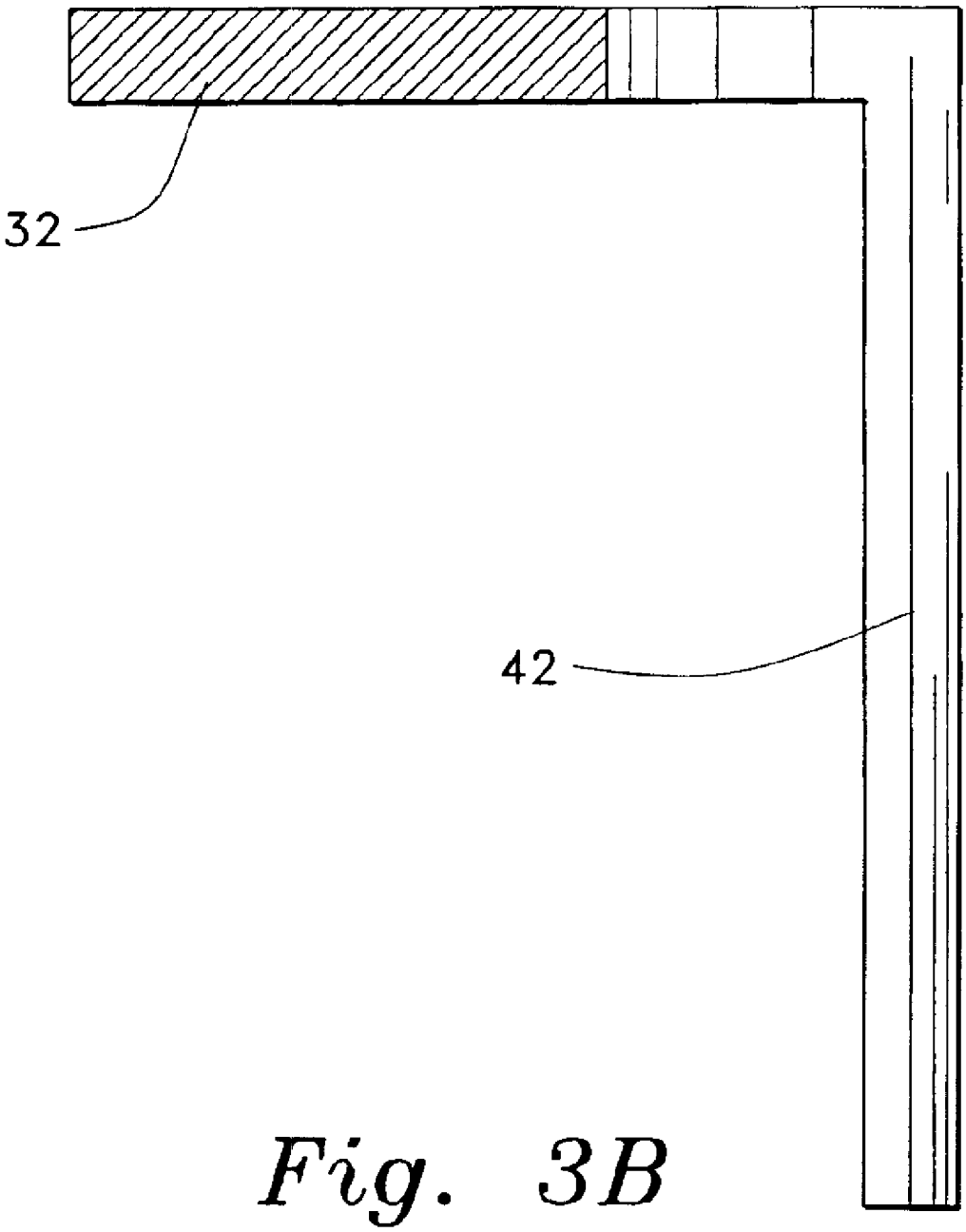
FIG. 3B is a section view along lines 3B—3B of FIG. 3A.
Figure 4A:
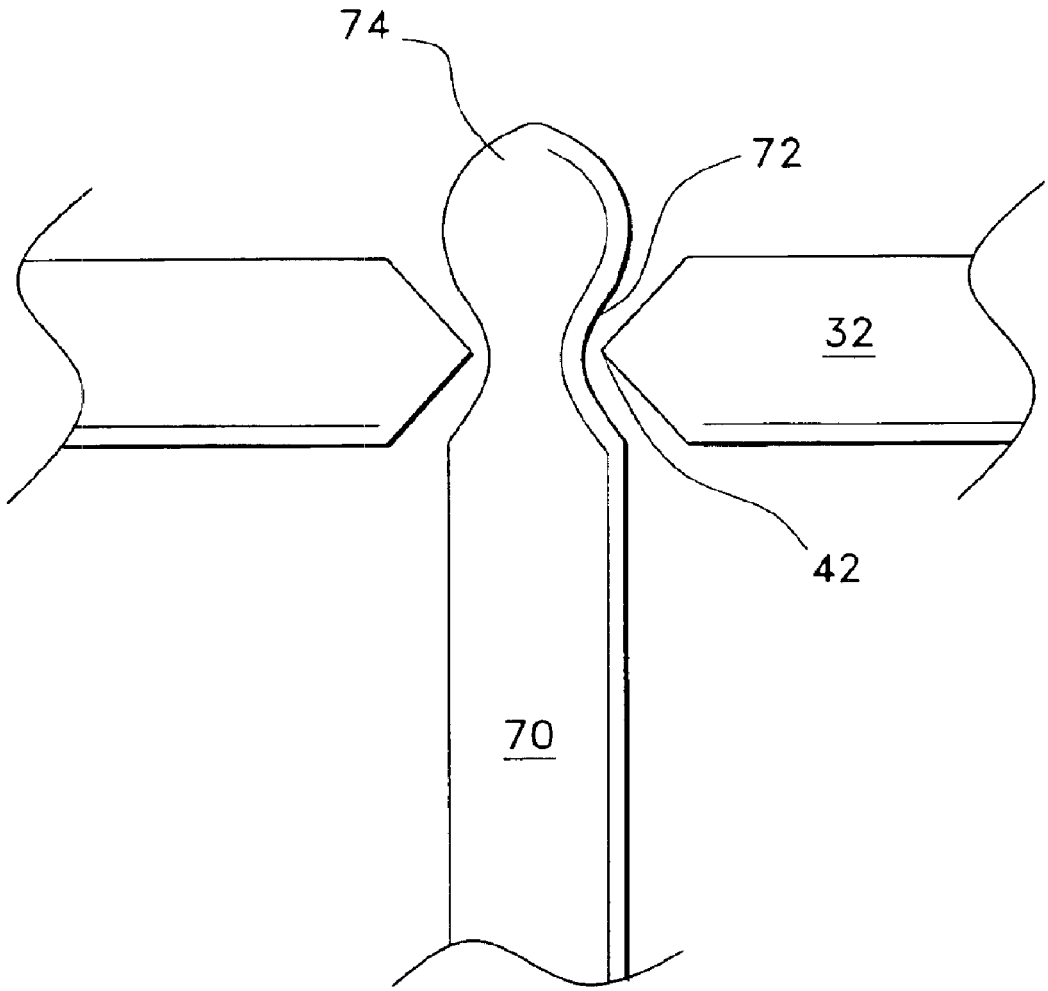
FIGS. 4A and 4B show fragmented elevational views of the contact of the adjustable pin with the knife-edged bracket in the locking and tuning stabilizing device of the present invention.
Figure 4B:
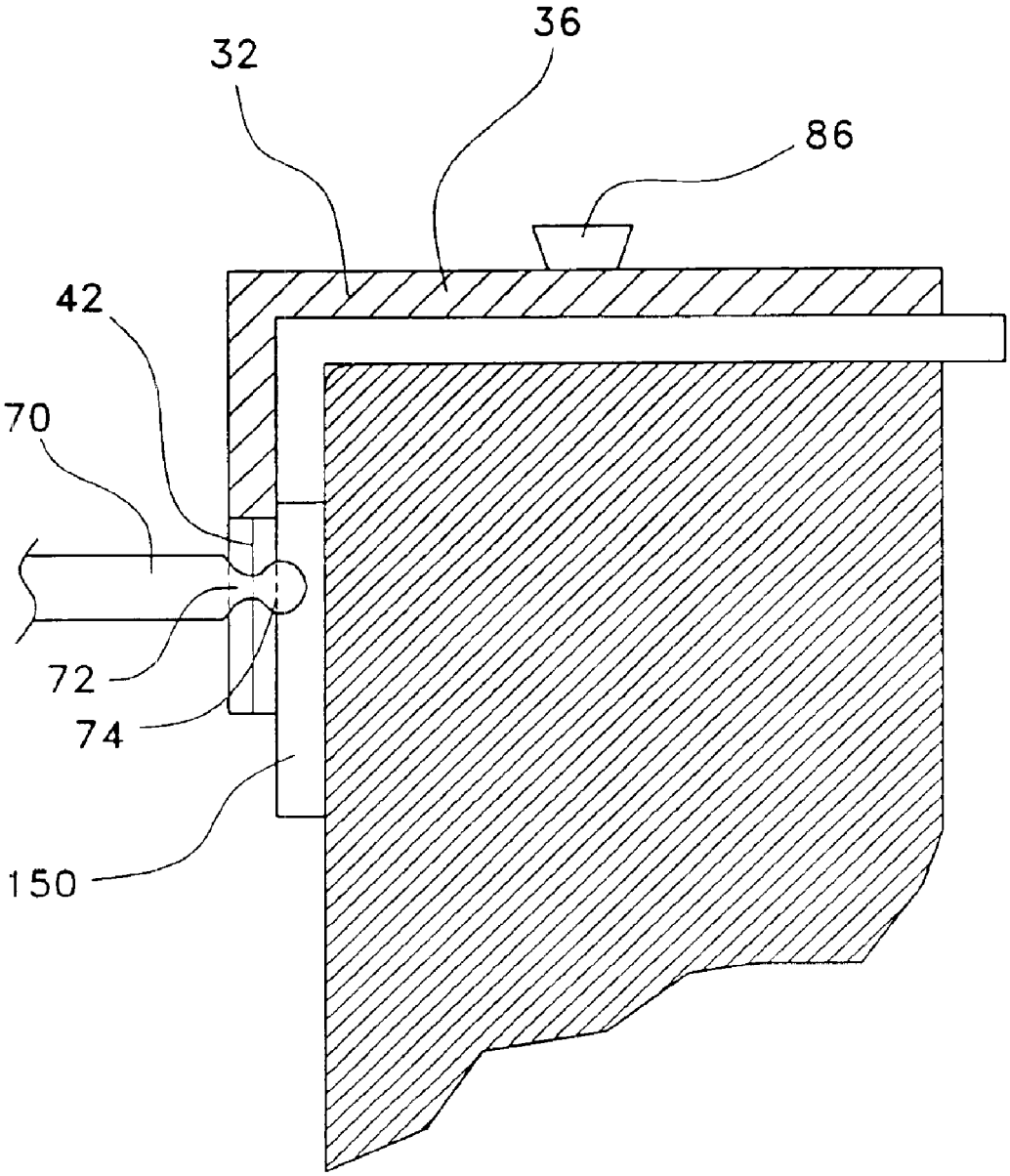

An inner L-shaped tremolo bracket 36, and an outer, L-shaped tremolo bracket 32 which overlaps the inner bracket 36, are fixed to the tremolo block 150, e.g., by fasteners 86. As shown in FIGS. 3A and 3B, outer bracket 32 is an angle formed by two plates connected at right angles. A slot 34 is defined through one of the plates, bisecting the plate and extending partially into the second plate. The edges 42 of the bisected plate at the slot 34 are beveled. As shown in FIG. 4B, the inner bracket has a recess or slot 38 defined therein which is aligned with the slot 34.

The end of the pin 70 opposite spring 50 has a neck 72 defining a ball head 74 at the end of the pin 70. As shown in FIGS. 4A and 4B, the neck 72 of the pin 70 slides between the beveled edges 42 of the slot 34, the head 74 of the pin being accommodated by the recess or slot 38 defined in inner bracket 36, so that pin 70 is attached to tremolo block 150, the block 150 being free to move in response to tremolo arm by the sliding movement of brackets 32 and 36 on the head 74 of pin 70.

Second bore 78 may be threaded, or a threaded sleeve may be fixed in the second bore 78, or the opening 64 in sleeve 62 may be internally threaded, to receive a clamp screw 40. Clamp screw 40 is of sufficient length that it extends through opening 64 to clamp pin 70 against the opposing wall of sleeve 62 when in the locked position, thereby preventing axial movement of pin 70. In the unlocked position, clamp screw 40 is withdrawn into second bore 78 just sufficiently to permit axial movement of pin 70.

In operation, when the guitarist wishes to produce a tremolo effect, the clamp screw 40 on the front face of the guitar body is moved to the unlocked position. When the guitarist wishes to preclude the tremolo effect, the clamp screw 40 is moved to the locked position to preclude axial movement of pin 70, thereby precluding rocking of tremolo block 150. In the locked position, tuning stability is greatly increased.

Figure 10:
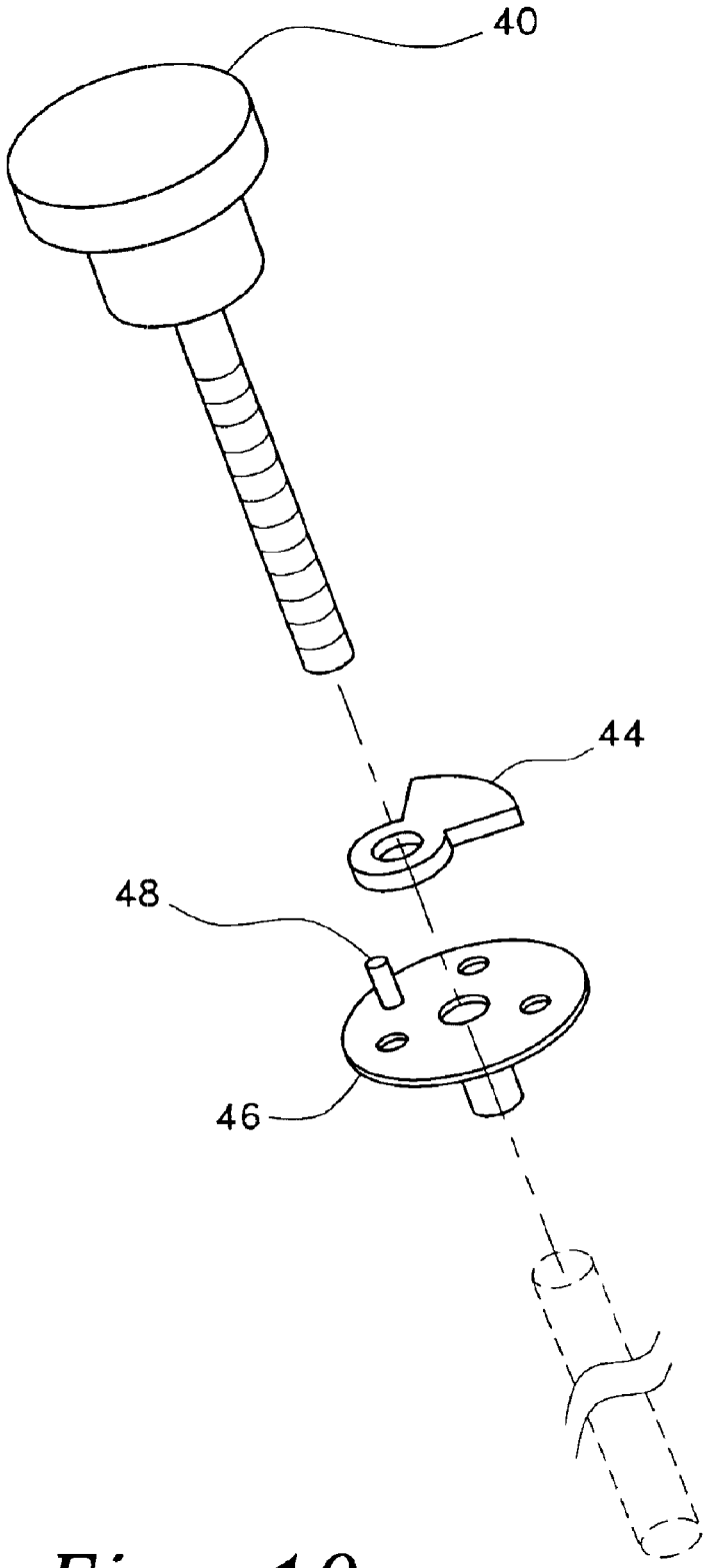
FIG. 10 is an exploded view of a clamp screw of a guitar tremolo locking and tuning stabilizing device according to the present invention.
Figure 11:
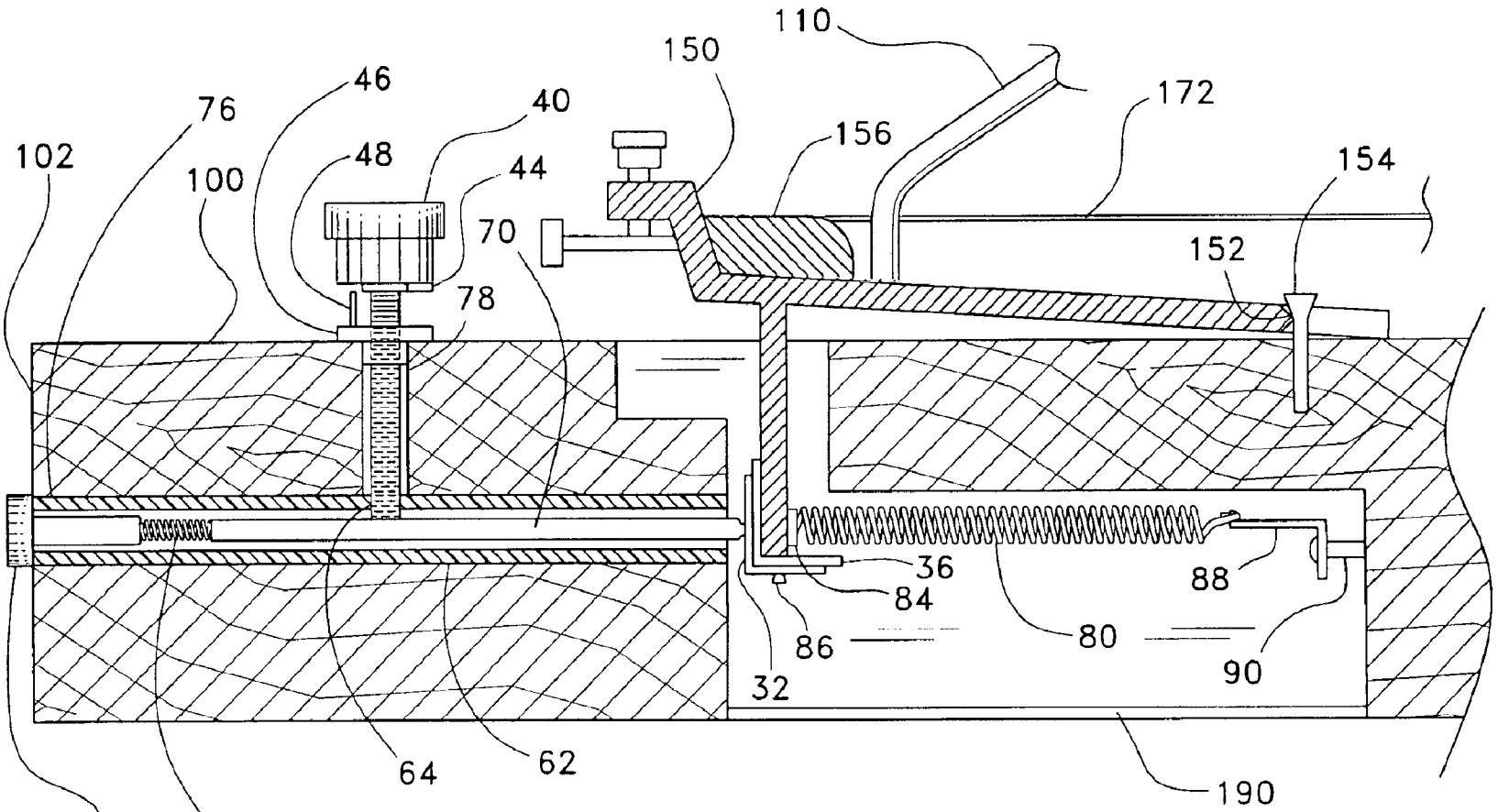
FIG. 11 is a section view similar to FIG. 1C, showing rotation limiting hardware disposed on the clamp screw of a guitar tremolo locking and tuning stabilizing device according to the present invention.

Referring to FIGS. 10 and 11, the clamp screw 40 may include hardware to prevent the clamp screw 40 from being excessively tightened or backed too far out of the second bore 78. A threaded flange 46 is pressed into the guitar body at the top of the second bore 78. A pin 48 extends from the top surface of the threaded flange 46. A semi-circular stop 44 is fastened to the clamp screw 40 so that, once the clamp screw 40 is properly positioned, the pin 48 and the semi-circular stop 44 prevent the clamp screw 40 from being turned more than a single partial turn.

Figure 6:
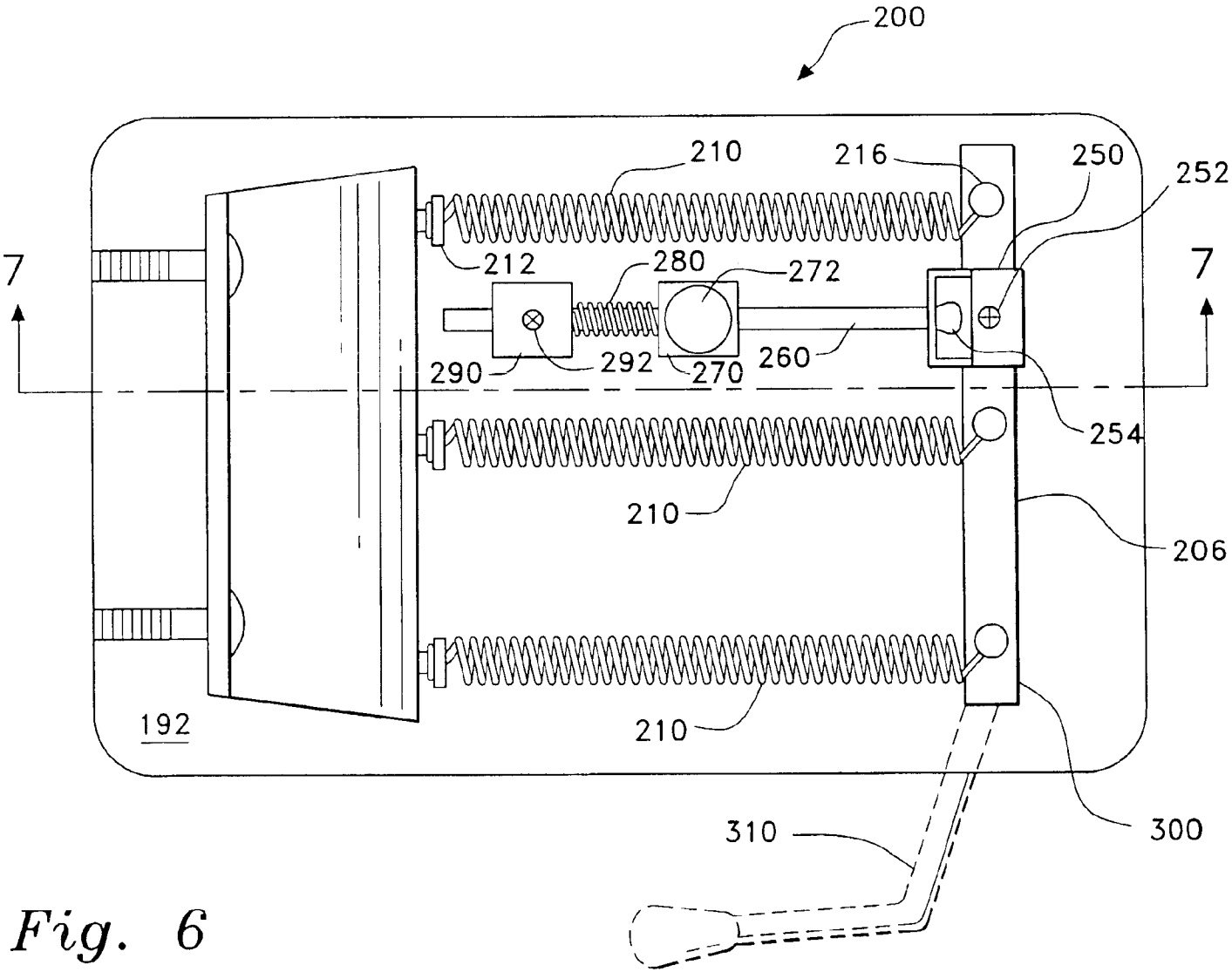
FIG. 6 shows a plan view of a second embodiment of a guitar tremolo locking and tuning stabilizing device according to the present invention.
Figure 7:
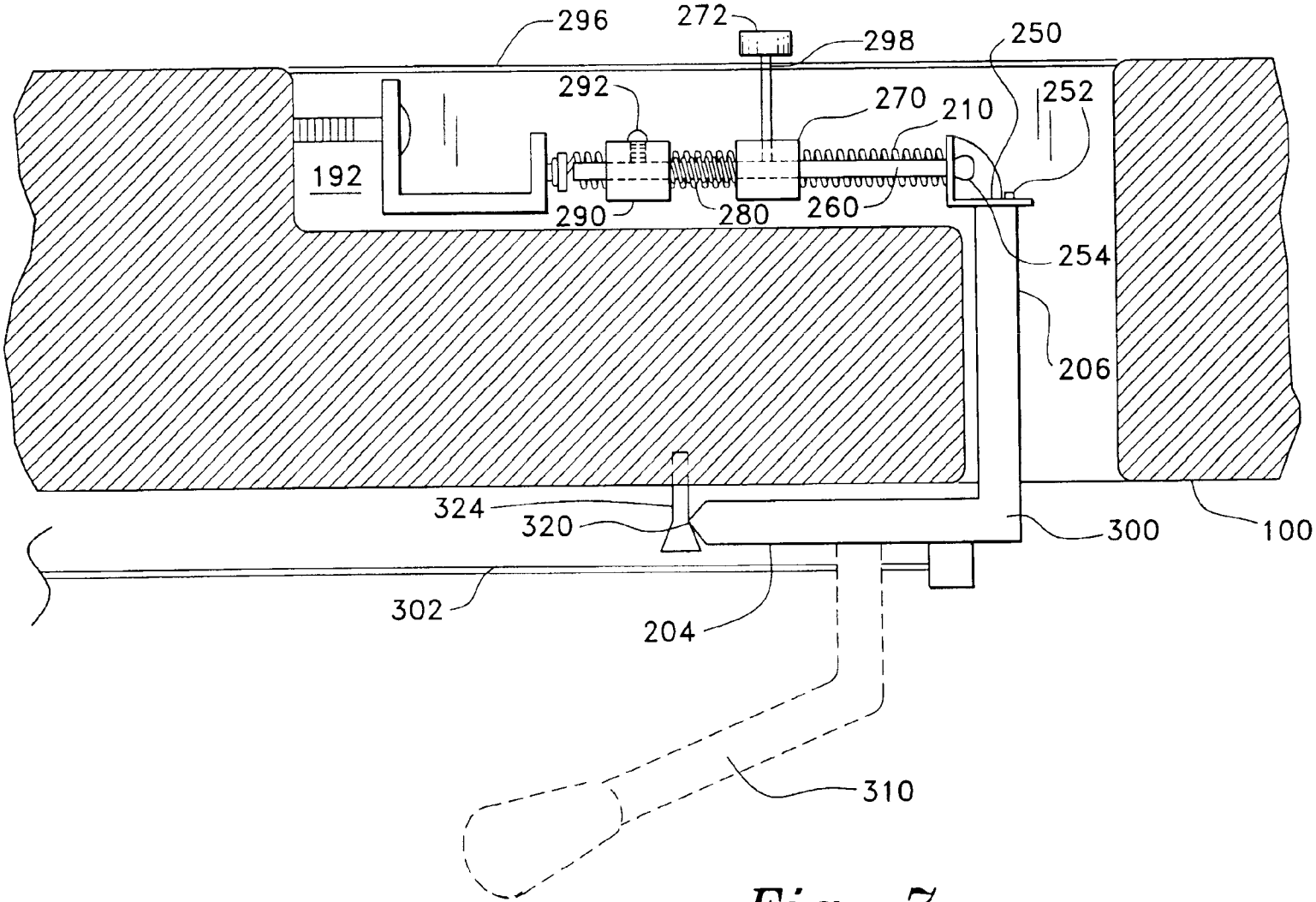
FIG. 7 is a section view along the lines 7—7 of FIG. 6.

A second embodiment of the locking and tuning stabilizing device, designated as 200 in the drawings, is shown in FIGS. 6 and 7. In this embodiment, no bores are made in the body of the guitar. The device 200 is entirely enclosed in the cavity 192 and accessed through a cover 296 in the rear face of the body of the guitar, similar to the cover 190 shown in FIG. 1B. The tremolo device is again conventional in construction, and includes tremolo block 300, tremolo arm 310, knife-edge 320, pivot screws 324, strings 302, and tremolo springs 210 connected to tremolo block 300 by fasteners 216, and fixed to a bracket attached to the body by fasteners 212, all of which are similar in construction and operation to the tremolo device discussed above. The tremolo block 300 has a first leg 204 extending parallel to the body of the guitar 100, and a second leg 206 extending into the cavity 192.

In this embodiment, the locking and tuning stabilizing device includes an L-shaped bracket 250 fixed to the second leg 206 of the tremolo block 300 by fastener 252. Pin 260 has a head 254 at one end that is pivotally attached to L-shaped bracket 252. Two collars are disposed about pin 260. A first collar 290 is fixed to the pin 260 near the end opposite head 254 by fastener 292, and a second collar 270 is slidably disposed on pin 260 between bracket 250 and first collar 290. A bias spring 280 is axially disposed about pin 260 between first collar 290 and second collar 270. Clamp screw 272 extends through a hole 298 in cavity cover 296 and through a threaded transverse bore defined through the second collar 270.

In operation, clamp screw 272 is moved to an unlocked position which permits axial movement of pin 260, thereby permitting normal operation of the tremolo device to produce tremolo sound effects. With the clamp screw 272 turned into collar 270 to clamp pin 260 in a locked position, pin 260 is prevented from moving axially, thus prohibiting the tremolo block 300 from moving. In the locked position, tuning stability is greatly increased.

Figure 8:
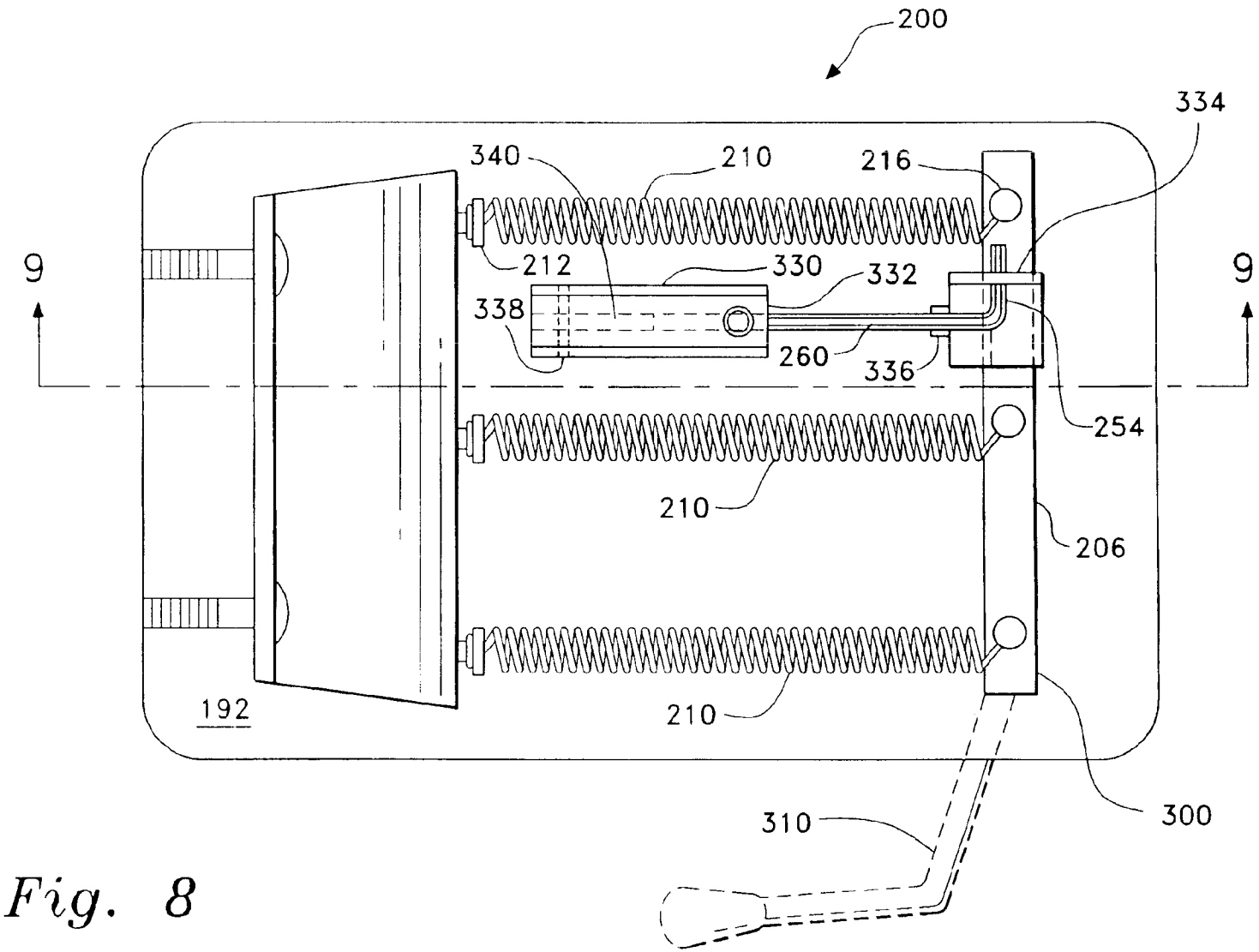
FIG. 8 shows a plan view of a third embodiment of a guitar tremolo locking and tuning stabilizing device according to the present invention.
Figure 9:
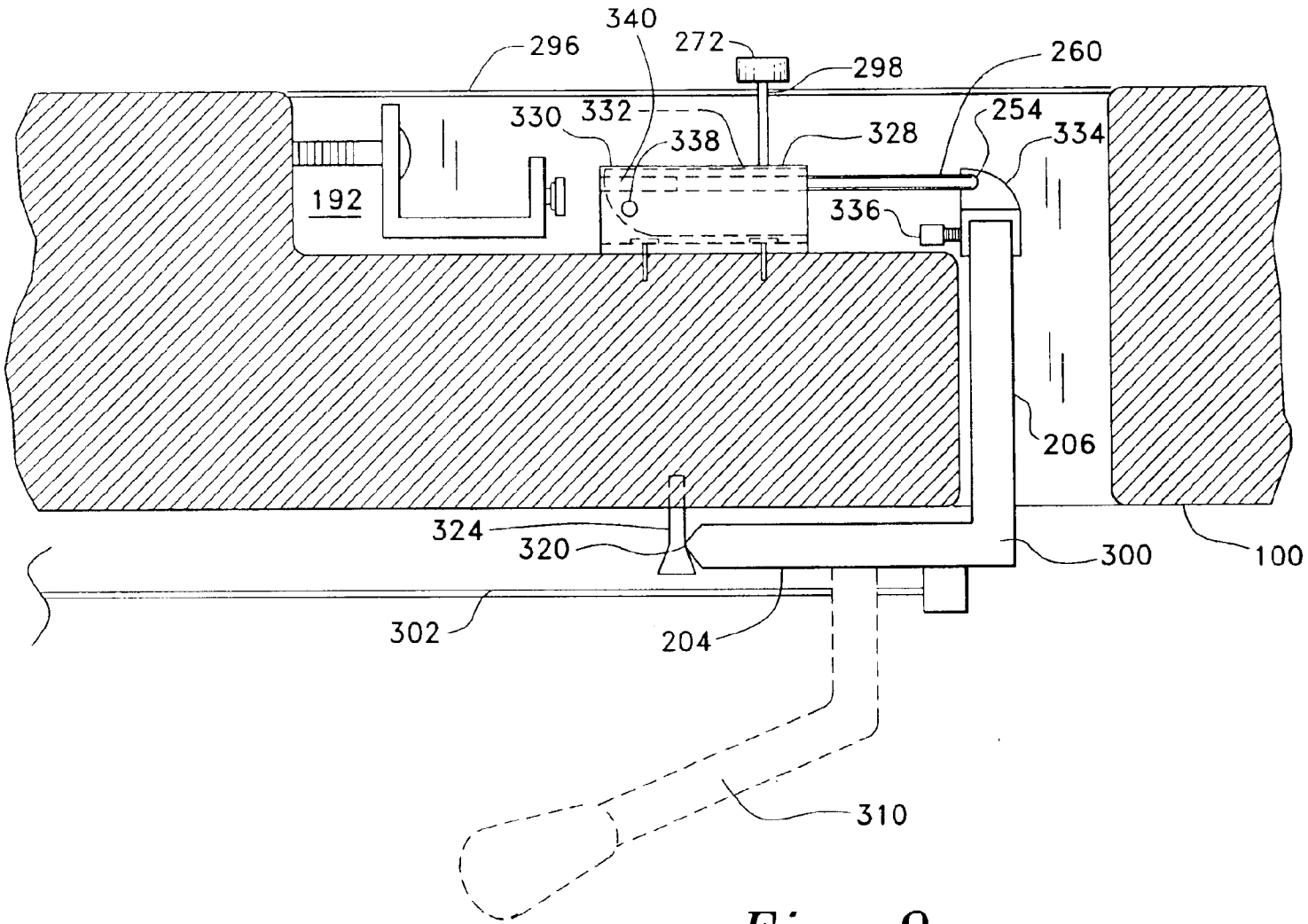
FIG. 9 is a section view along the lines 9—9 of FIG. 8.

A third embodiment of the locking and tuning stabilizing device, similar to the second embodiment, is shown in FIGS. 8 and 9. In this embodiment, as in the second embodiment, no bores are made in the body of the guitar. The tremolo device is again conventional in construction, and includes tremolo block 300, tremolo arm 310, knife-edge 320, pivot screws 324, strings 302, and tremolo springs 210 connected to block 300 by fasteners 216, and fixed to a bracket attached to the body by fasteners 212, all of which are similar in construction and operation to the tremolo device discussed above. The tremolo block 300 has a first leg 204 extending parallel to the body of the guitar 100, and a second leg 206 extending into the cavity 192.

In this embodiment, the locking and tuning stabilizing device includes a clamp bracket 334 fixed to the second leg 206 of the tremolo block 300 by setscrew 336. The head 254 of pin 260 is defined by a right angle bend in pin 260. The head 254 is pivotally attached to the clamp bracket 334. Anchor 328 is fastened against the floor of the cavity 192. The anchor 328 comprises a "U" bracket 330 or channel that is fastened to the floor of the cavity 192, and an anchor block 332 or bar pivotally retained within the "U" bracket 330, pivotal about pivot pin 338. Because anchor block 332 is pivotally retained within the "U" bracket 330, the anchor block 332 can be pivoted out of the way for installation. Pin 260 is received in a bore 340 defined longitudinally in anchor block 332. Clamp screw 272 is engaged in a threaded bore defined in anchor block 332 transverse to the bore 340, and can be tightened to retain pin 260 in place. Clamp screw 272 extends through a hole 298 in the cavity cover 296.

In operation, clamp screw 272 is moved to an unlocked position which permits axial movement of pin 260, thereby permitting normal operation of the tremolo device to produce tremolo sound effects. With the clamp screw 272 turned into the anchor block 332 to clamp pin 260 in a locked position, pin 260 is prevented from moving axially, thus prohibiting the tremolo block 300 from moving. In the locked position, tuning stability is greatly increased.

It is to be understood that the present invention is not limited to the sole embodiments described above, but encompasses any and all embodiments within the scope of the following claims.

I claim:

1. A locking and tuning stabilizing device for a guitar with a tremolo device, the tremolo device having a tremolo block pivotal against a pivot screw on the face of the guitar, the locking and tuning stabilizing device comprising:

an elongated pin having a first end and a second end, the first end being adapted for attachment to the tremolo block;

a cylinder disposed about said pin, the cylinder having first and second ends, the first end of said pin extending from the first end of the cylinder, said pin being slidable in the cylinder, the cylinder having a transverse threaded bore defined therein; and a clamp screw engaging the threaded bore in said cylinder;

wherein said clamp screw is movable between an unlocked position in which said pin is slidable in said cylinder in order to permit the tremolo block to pivot, and a locked position in which said clamp screw clamps said pin within said cylinder so that the pin is not slidable in said cylinder in order to prevent the tremolo block from pivoting.

2. The locking and tuning stabilizing device according to claim 1, further comprising means for attaching the first end of said pin to the tremolo block.

3. The locking and tuning stabilizing device according to claim 1, wherein the second end of said cylinder is internally threaded, the locking and tuning stabilizing device for a guitar further comprising:

an adjustment screw engaged within the second end of said cylinder; and a compression spring disposed within said cylinder between said adjustment screw and the second end of said pin.

4. A locking and tuning stabilizing device for a guitar with a tremolo device, the tremolo device having a tremolo block pivotal against a pivot screw on the face of the guitar, the locking and tuning stabilizing device comprising:

an elongated pin having a first end and a second end, the first end being adapted for attachment to the tremolo block;

means for attaching the first end of said pin to the tremolo block;

an anchor having a first bore and a second bore defined therein, the first bore being adapted to receive the second end of said pin, the second bore being transverse to and joining the first bore, the second bore being threaded;

a clamp screw engaging the second bore;

wherein said clamp screw is movable between an unlocked position in which said pin is slidable in said anchor block in order to permit the tremolo block to pivot, and a locked position in which said clamp screw clamps said pin within said anchor so that said pin is not slidable in said anchor block in order to prevent the tremolo block from pivoting.

5. The locking and tuning stabilizing device according to claim 4, wherein said pin extends through said anchor, the stabilizing device further comprising:

a collar disposed on the second end of said pin; and a spring disposed about said pin between said collar and said anchor.

6. The locking and tuning stabilizing device according to claim 4, wherein said anchor further comprises:

a "U" shaped channel; and an anchor block pivotally attached within said "U" shaped channel, the first bore and the second bore being defined in the anchor block.

* * * * *